US011156422B1

(12) United States Patent
Doukakis et al.

(10) Patent No.: US 11,156,422 B1
(45) Date of Patent: Oct. 26, 2021

(54) METHOD AND APPARATUS FOR DECOCKING M1911 STYLE PISTOL

(71) Applicants: George Doukakis, Katonah, NY (US); Maria Doukakis, Katonah, NY (US)

(72) Inventors: George Doukakis, Katonah, NY (US); Maria Doukakis, Katonah, NY (US)

( * ) Notice: Subject to any disclaimer, the term of this patent is extended or adjusted under 35 U.S.C. 154(b) by 0 days.

(21) Appl. No.: 16/920,668

(22) Filed: Jul. 4, 2020

(51) Int. Cl.
*F41A 19/47* (2006.01)
*F41A 19/48* (2006.01)

(52) U.S. Cl.
CPC ..... *F41A 19/47* (2013.01); *F41A 19/48* (2013.01)

(58) Field of Classification Search
CPC ..... F41A 19/47; F41A 19/48; F41A 19/52; F41A 17/72; F41A 17/74
USPC ... 42/108, 7, 69.03, 70.08, 69.02, 69.01, 14; 89/147, 148
See application file for complete search history.

(56) References Cited

U.S. PATENT DOCUMENTS 4,589,327 A * 5/1986 Smith ..... F41A 17/74 42/70.08
5,216,195 A * 6/1993 Tuma ..... F41A 17/82 89/147
5,303,494 A * 4/1994 Tuma ..... F41A 17/56 42/70.04
5,596,162 A * 1/1997 Burns ..... F41A 19/46 84/142
6,415,702 B1 * 7/2002 Szabo ..... F41A 17/28 42/70.08
7,698,845 B2 * 4/2010 Hochstrate ..... F41A 19/13 42/69.03
8,127,481 B2 * 3/2012 Rozum ..... F41A 17/00 42/70.08
2002/0020100 A1 * 2/2002 Roca ..... F41A 19/44 42/70.11
2002/0056359 A1 * 5/2002 Szabo ..... F41A 19/48 89/148
2003/0070342 A1 * 4/2003 Baker ..... F41A 19/48 42/69.03
2005/0229462 A1 * 10/2005 McGarry ..... F41A 17/72 42/70.08
2006/0150466 A1 * 7/2006 Hochstrate ..... F41A 19/45 42/69.03
2012/0023801 A1 * 2/2012 Rozum ..... F41A 17/00 42/70.08

FOREIGN PATENT DOCUMENTS

EP 550238 A1 * 12/1992 ..... F41A 17/74

* cited by examiner

*Primary Examiner* — John Cooper
(74) *Attorney, Agent, or Firm* — Gugliotta & Gugliotta LPA

(57) ABSTRACT

A system and method for providing true decocking mechanism into a 1911-style firearm is provided. A decocking lever, when pushed in one forward motion, automatically returns a cocked hammer to its resting position. The decocking lever initially pushes the firing pin forward, out of reach of the hammer, and then pushes against the sear to release the hammer in its typical fashion.

11 Claims, 6 Drawing Sheets

METHOD AND APPARATUS FOR DECOCKING M1911 STYLE PISTOL

RELATED APPLICATIONS

There are no previously filed, nor currently any co-pending applications, anywhere in the world.

BACKGROUND OF THE INVENTION

1. Field of the Invention

The present invention relates to a safety feature for a semi-automatic pistol and, more particularly, to a method and apparatus for safely decocking a 1911-style pistol (also referred to as "M1911", "1911A1", or just "1911").

2. Description of the Related Art

The "1911 style" pistol is a single-action, semi-automatic, magazine-fed recoil operated pistol chambered for the 0.45 ACP cartridge. Later adaptations were developed using alternate ammunition, including 0.22, 0.38 Super, 9×19 mm Parabellum, 0.40 S&W, 10 mm Auto, 0.400 Corbon, 0.460 Rowland, 0.22 LR, 0.50 GI, 0.455 Webley, 9×23 mm Winchester, and others, with the most popular alternative versions being 9×19 mm Parabellum, 0.38 Super and 10 mm Auto. Originally designed by John Browning in the late 1890s as a replacement for the revolvers then used, the "1911 style" firearm has become a widely used style of sidearm, both within the military and law enforcement, as well as in civilian use.

As shown according to the PRIOR ART in conjunction with FIG. 1, the pistol's basic principal of operation utilizes the expanding combustion gasses that force the bullet (not shown) down the barrel 1 to provide a reverse momentum to the slide 47 and barrel 1 (which are locked together during this portion of the firing cycle). After the bullet has left the barrel 1, the slide 47 and barrel 1 continue rearward a short distance. At this point, a barrel link 3 pivots about a barrel link pin 4 to rotate the rear of the barrel 47 downward, out of locking recesses formed within the slide. This stops the barrel 47 from making contact between the lower barrel lugs and a vertical impact surface of the frame 39. As the slide 47 continues rearward, a claw extractor 8 urges a spent casing from the firing chamber. A ejector 6 strikes the rear of the spent casing, pivoting it out and away from the pistol. The slide 47 stops and is then propelled forward by a recoil spring 41 to strip a fresh cartridge (not shown) from the magazine 21 and feed it into the firing chamber. At the forward end of its travel, the slide 47 locks into the barrel 1 and is ready to fire again.

Various improvements have occurred since the basic operational mechanism was developed. A grip safety 14 is an automatic safety feature and allows operation only when the grip 13 is grasped. A thumb safety 50 is provided as an additional manual safety feature operated by the user. A disconnector 5 impinges the sear 44 to prevent firing out of battery. A slide stop 48 is further provided on most standard 1911's.

The same basic design has been offered commercially and in widespread use. However, the design of a single action semiautomatic pistols such as 1911-style firearms allow the hammer 17 can be cocked by a user's thumb or by sliding back the slide 47 either manually or due to a shot. In both cases, the hammer 17 always stands in the same cocked position. While this allows only some pressure of the forefinger on the trigger to fire the weapon, in the event the user dies not wish to fire the weapon the hammer remains in the cocked position and must somehow be safely decocked. While guns of this kind may be locked with the hammer in the cocked position, the only way to decock the gun after its unlocking is to thumb the hammer and lead it down, little by little, after pull the trigger.

The risk of accidental shots due to the trigger sensitivity when the gun is unlocked requires its carrying inside a holster always locked or with the hammer down and unlocked. In both cases, a sudden draw out of the pistol requires a conscious act to either unlock or to cock it with the thumb.

Some methods and devices are known that incorporate various mechanisms for providing prevention from unintended operation of the firearm. For example:

U.S. Pat. No. 8,127,481, issued in the name of Rozum et al., discloses a 1911-style semiautomatic pistol thumb safety or decocking lever adapted to be coupled to a model 1911 receiver. The thumb safety has a selector pivotally coupled about an axis of rotation to a side of the model 1911 receiver the selector having a flat surface portion offset from the axis of rotation and contacting the side. The selector has a raised surface portion offset from the axis of rotation and facing the side. The safety is adapted to be selectable from a first position to a second position. The flat surface portion covers a swept area when the safety is rotated from the first position to the second position. The swept area is covered by the raised surface portion in either the first position or the second position.

U.S. Pat. No. 6,415,702, issued in the name of Szabo et al, discloses a double action semi-automatic 1911-style handgun that includes a double action trigger assembly. The hammer of the handgun is cocked and released by a drawbar mounted internally to the frame. The handgun also includes a grip mounted safety device to prevent accidental discharging of the handgun and a device to de-cock the handgun without discharging a chambered round.

Several companies have developed a firing pin block safety. Colt's 80 series uses a trigger operated one and several other manufacturers, including Kimber and Smith & Wesson, use a Swartz firing-pin safety, which is operated by the grip safety.

Consequently, a need has been felt for providing an apparatus and method which disables and decocks a 1911-style semi-automatic handgun in addition to the use of the conventional grip safety and thumb safety.

SUMMARY OF THE INVENTION

It is thus an object of the present invention to provide a method of decocking a 1911-style firearm.

It is another object of the present invention to provide a device within a 1911-style firearm for enabling a method of decocking.

It is a feature of the present invention to provide a 1911-style firearm incorporating a decocking lever that automatically decocks a cocked hammer.

Briefly described according to a preferred embodiment of the present invention, a true decocking apparatus is adapted into a 1911-style firearm. A decocking lever, when pushed in one forward motion, automatically returns a cocked hammer to its resting position. The decocking lever initially pushes the firing pin forward, out of reach of the hammer, and then pushes against the sear to release the hammer in its typical fashion.

Further object, features and advantages of the invention will become apparent in the course of the following description.

REFERENCE NUMERALS

1 - barrel
2 - barrel busing
3 - barrel link
4 - barrel link pin
5 - disconnector
6 - ejector
7 - ejector pin
8 - extractor
9 - firing pin
10 - firing pin spring
11 - firing pin stop
12 - front sight
13 - grip
14 - grip safety
15 - grip screw
16 - grip screw bushing
17 - hammer
18 - hammer pin
19 - hammer strut
20 - hammer strut pin
21 - magazine
22 - magazine base pad
23 - magazine body
24 - magazine follower
25 - magazine release
26 - magazine release lock
27- magazine release spring
28- magazine spring
29 - magazine well
30 - mainspring
31 - mainspring cap
32 - mainspring cap pin
33 - mainspring housing
34 - mainspring housing pin
35 - mainspring housing pin retainer
36 - plunger spring
37 - plunger tube
38 - rear sight
39 - receiver or frame
40 - recoil buffer
41 - recoil spring
42 - recoil spring guide rod
43 - recoil spring plug
44 - sear
45 - sear pin
46 - sear spring
47 - slide
48 - slide stop
49 - slide stop plunger
50 - thumb safety
51 - thumb safety plunger
52 - trigger
101 - return spring
102 - eccentric linkage connectoin
104 - linkage
106 - dovetail groove
110 - pivot lever
112 - first nub
114 - second nub
116 - stop base
118 - decocking pluuunger
120 - ejector conduit
121 - decocking plunger
122 - decocking plunger spring

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the Figures. It should be understood that the legal scope of the description is defined by the words of the claims set forth at the end of this patent and that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims.

It should also be understood that, unless a term is expressly defined in this patent there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. § 112, sixth paragraph.

The best mode for carrying out the invention is presented in terms of its preferred embodiment, herein depicted within the Figures.

1. Detailed Description of the Figures

Figure 1:
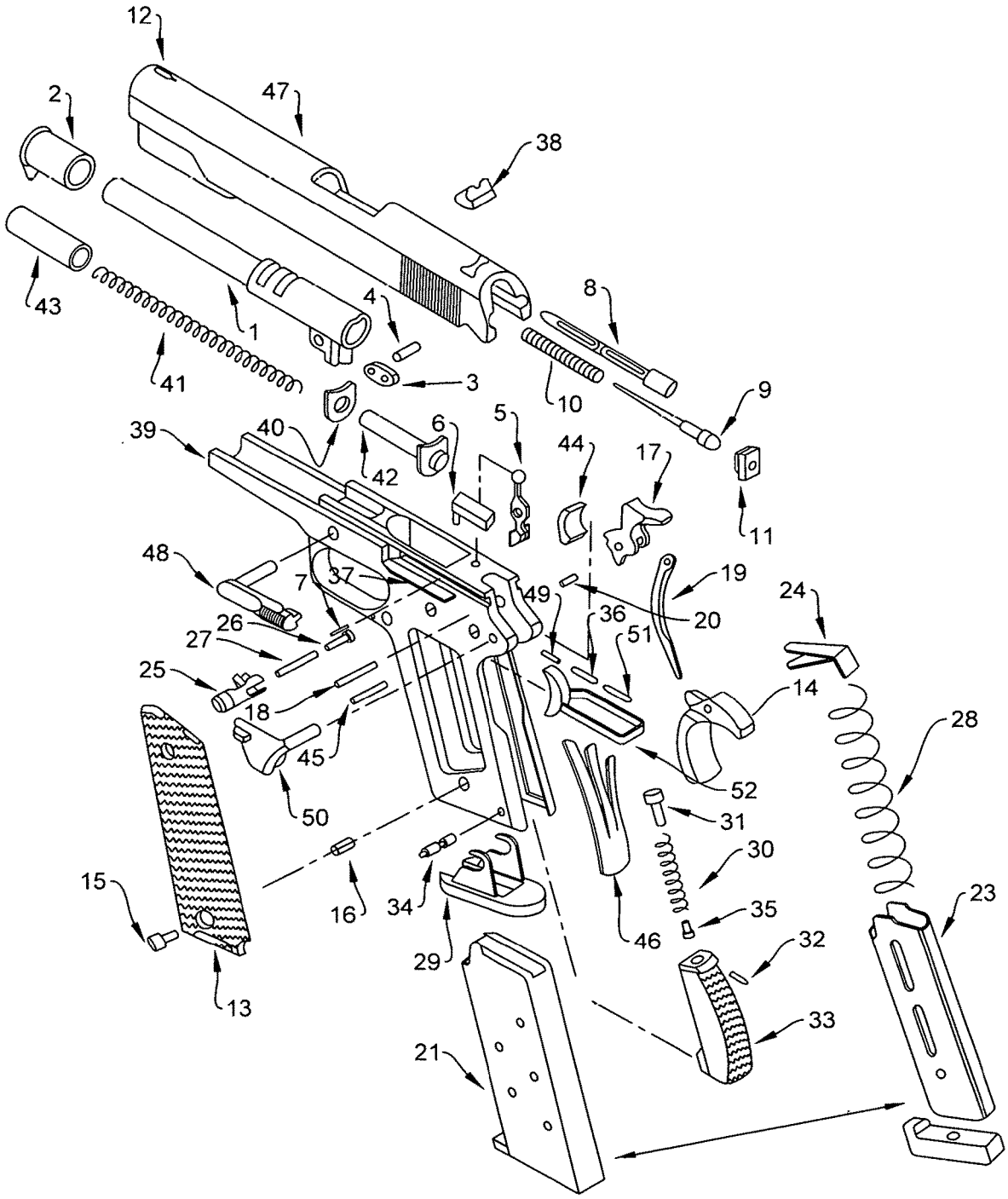
PRIOR ART FIG. 1
FIG. 1 is an exploded perspective view of a 1911-style semiautomatic pistol illustrating all of the internal components of the firearm according to the PRIOR ART.
Figure 2:
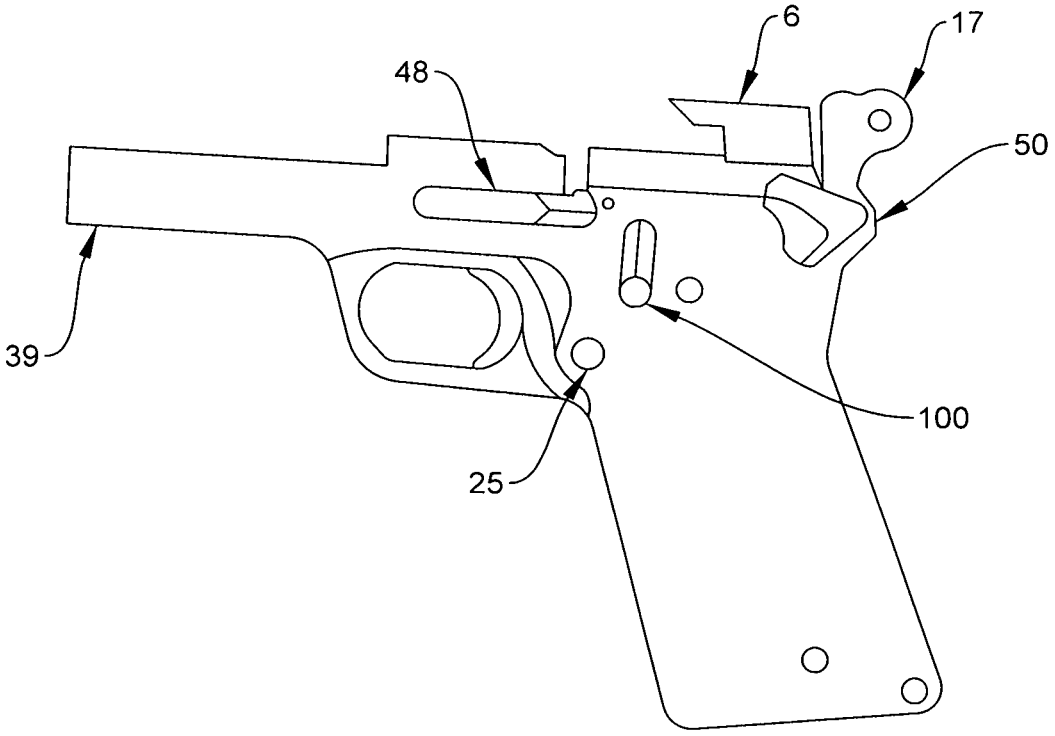
FIG. 2 is a left side elevational view of a receiver or frame 39 of a 1911-style semiautomatic pistol according to the preferred embodiment of the present invention.
Figure 3:
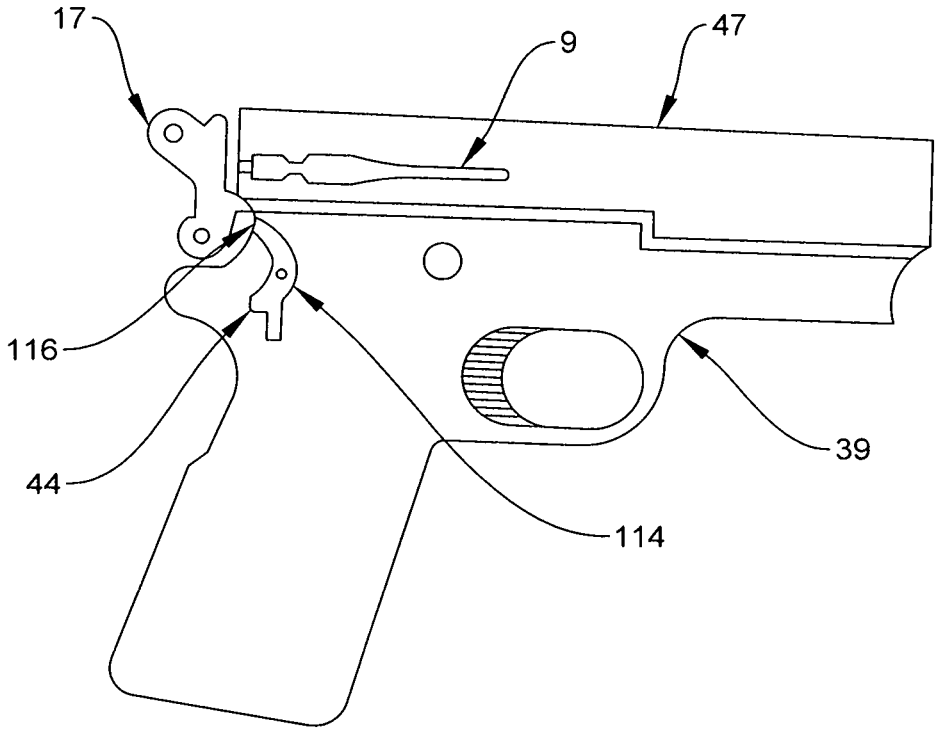
FIG. 3 is a partial fragmentary right side elevational view thereof.
Figure 4:
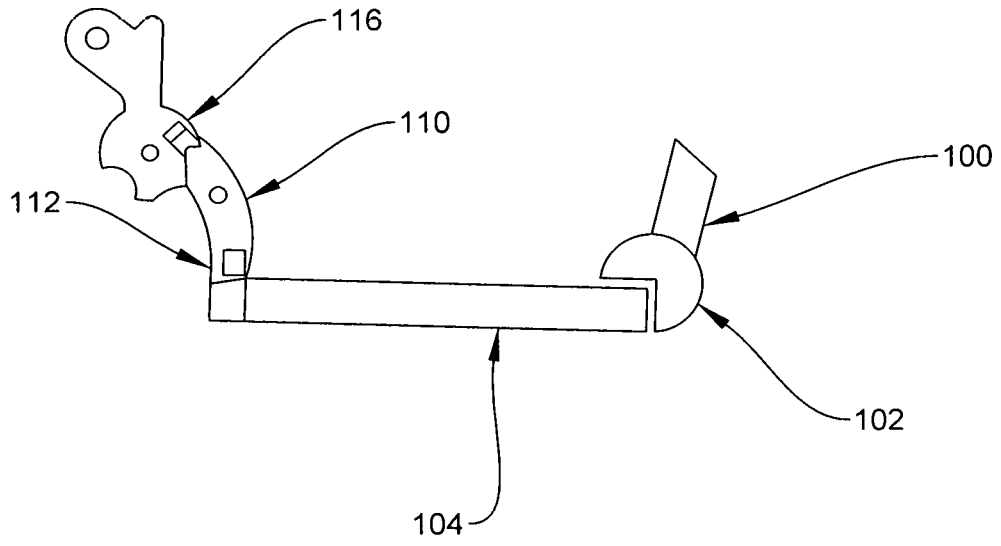
FIG. 4 is a rights side elevational schematic of the decocking apparatus according to the preferred embodiment of the present invention.
Figure 5:
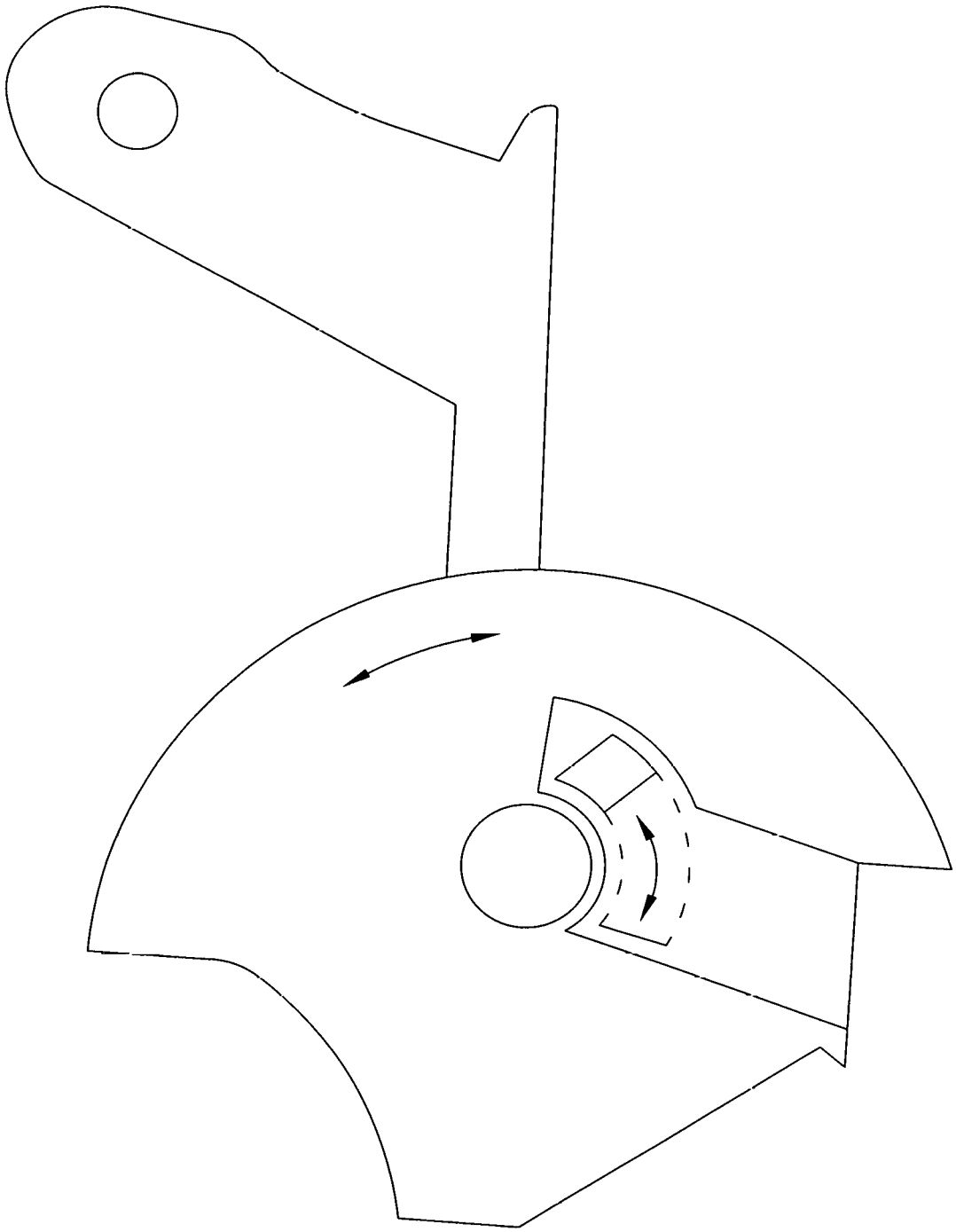
FIG. 5 and FIG. 6 are views of the firing pin housing area for use therewith, shown cocked and uncocked respectively.
Figure 6:
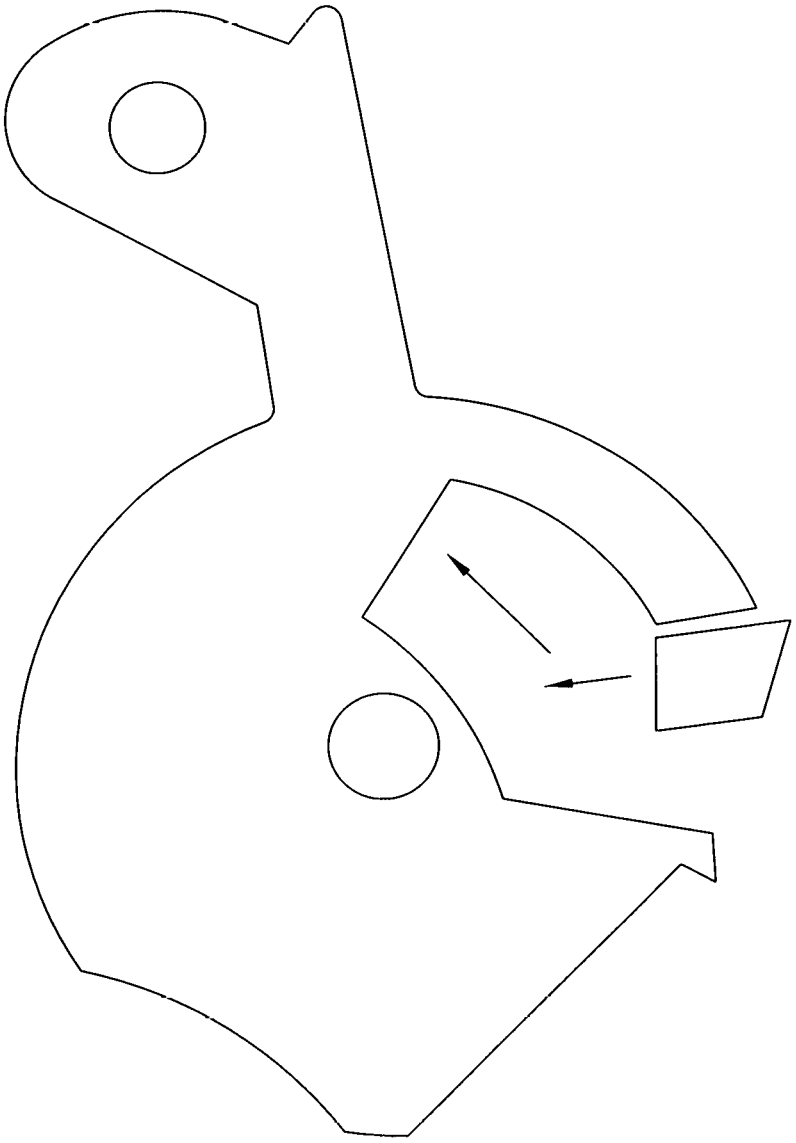

Referring now to FIG. 2 through FIG. 6, wherein like reference numerals indicate the same parts throughout the several views, a decocking lever 100 is located on the left side of the receiver or frame 39. As configured for a right-handed user, the user's right thumb (not shown) is used to push the decocking lever 100 from the 12 o'clock position to its full travel at 10 o'clock position. In this position the decocking lever 100 is unable to move forward when the hammer 17 is decocked or in half cock position. As the decocking lever 100 is pushed forward, the lever's eccentric linkage connection 102 on the inside of the frame 39 pushes the linkage 104 rearward.

As the linkage 104 moves rearward, it pushes against the bottom of the pivot lever 110 which consists of two nubs 112, 114. The first pivot lever nub 112 located at the bottom of the pivot lever 110 is to activate the sear 44 and the second pivot lever nub 114 is located on the top of the pivot lever 110 is to create an interference or stop to the hammer 17. When the bottom of the pivot lever 110 is pushed rearward, the second nub 114 moves forward, out of the channel 106 which is machined around the pin hole of the hammer 17. The channel 106 gives clearance to the hammer stop nub 114 under normal firing operation. When hammer stop nub 114 is moved/pushed outside of channel 106, it is aligned with the stop base 116 of the hammer 17.

As the top hammer stop nubb 114 is aligned with the stop base 116 of the hammer 17, the bottom sear nubb 112 activates the sear 44 which allows the fully cocked hammer 17 to be released and the hammer 17 thereafter being stopped when stop base 116 on hammer 17 makes contact with the stop nubb 114 on the pivot lever 110. At this time, the hammer has decocked to a position approximately 70% from its full throw.

As the decocking lever 100 is released, the stop nubb 114 on pivot lever 110 is forced to return into the channel 106 of the hammer 17 because of the contact angles of the hammer stop base 116 and hammer stop nub 114 on pivot lever 110. As the hammer stop nubb 114 is returning into the channel 106 of the hammer 17, the hammer 17 continues to decock and the sear nub 112 on the pivot lever 110 is allowing the sear 44 to return to its non-activating position and thus stopping the hammer 17 to its "half cocked" position (which is actually only cocked approximately 5% from its full throw). At the half cocked position, (approximately 5%), the trigger 17 may be pulled to decock the hammer to its full decocked position, if desired.

In light of the above teachings, it is important to understand that the invention is not limited in its application to the specific details of the construction illustrated and the steps described herein. The invention is capable of other embodiments and of being practiced or carried out in a variety of ways. It is to be understood that the phraseology and terminology employed herein is for the purpose of description and not of limitation.

2. Operation of the Preferred Embodiment

In operation, several variations should be pointed out that may or may not be apparent to those having ordinary skill in the art in light of the present invention. First, a majority (i.e. estimate over 95%) of all pistols with external hammers, including 1911-style pistol, revolvers and other semi automatics, have a half cocked position (5% cocked) as a safety feature. Such a feature provides security in the event that the hammer gets unintentionally caught/pulled and then released accidentally. This can happen from a foreign object or when intentionally cocking the hammer with one's thumb and accidentally allowing it to slip before engaging the hammer to the fully cocked position.

Second, the present innovations may be incorporated into new 1911-style weapons, or may be retrofit to existing handguns. When retrofitting, machining on the inside of the frame must be performed to accommodate the decocking lever, linkage and pivot lever. In such retrofitting, the pivot lever 110 may be supported from the same disconnector pin 51 that supports the existing sear 44.

Finally, according to the present invention the decocking lever, linkage and pivot lever will automatically return to the rest position by means of the sear leaf spring being divided into two. The addition of a return spring may be added to the decocking lever under the left side hand grip in order to increase the return urging force.

The foregoing descriptions of specific embodiments of the present invention are presented for purposes of illustration and description. They are not intended to be exhaustive nor to limit the invention to precise forms disclosed and, obviously, many modifications and variations are possible in light of the above teaching. The embodiments are chosen and described in order to best explain principles of the invention and its practical application, to thereby enable others skilled in the art to best utilize the invention and its various embodiments with various modifications as are suited to the particular use contemplated. It is intended that a scope of the invention be defined broadly by the Drawings and Specification appended hereto and to their equivalents. Therefore, the scope of the invention is in no way to be limited only by any adverse inference under the rulings of *Warner-Jenkinson Company*, v. *Hilton Davis Chemical,* 520 US 17 (1997) or *Festo Corp.* v. *Shoketsu Kinzoku Kogyo Kabushiki Co.,* 535 U.S. 722 (2002), or other similar caselaw or subsequent precedent should not be made if any future claims are added or amended subsequent to this Patent Application.

What is claimed is:

1. A semiautomatic pistol decocking device comprising:

a decocking lever operatively affixed to a frame, said decocking lever capable of articulating between a first position to a second position, wherein at said second position said decocking lever is unable to move forward when a hammer is in an uncocked or half cocked position and moves forward when the hammer is fully cocked;

an eccentric linkage connection formed at a lower end of said decocking lever;

a linkage capable of being articulatably urged between a forward and rearward direction upon movement of the decocking lever;

a pivot lever urged by a forward articulation of said linkage, said pivot lever comprising:

a first pivot lever nub located at a bottom of the pivot lever and operatively interactive to activate a sear; and a second pivot lever nub located at a top of the pivot lever and operatively provides an interference or stop to a hammer.

2. The semiautomatic pistol decocking device of claim 1, wherein when the bottom of the pivot lever is urged rearward, the second pivot lever nub moves forward and the first pivot lever nub moves rearward.

3. The semiautomatic pistol decocking device of claim 2, whereby when the second pivot lever nub is moved forward it is aligned with a stop base formed in the hammer.

4. The semiautomatic pistol decocking device of claim 3, wherein when the second pivot lever nub is aligned with the stop base of the hammer, the first pivot lever nub activates the sear and thereby allows a fully cocked hammer to be released such that the hammer is stopped via contact with the stop base at a partially decocked position.

5. The semiautomatic pistol decocking device of claim 4, wherein said decocking lever is adapted and configured for a right-handed user such that a user's right thumb is used to articulate the decocking lever.

6. The semiautomatic pistol decocking device of claim 5 adapted such as to be retrofit into an existing semiautomatic pistol.

7. The semiautomatic pistol decocking device of claim 4 adapted such as to be retrofit into an existing semiautomatic pistol.

8. The semiautomatic pistol decocking device of claim 4, wherein the semiautomatic pistol is adapted for both single action and double action operation.

9. In a semiautomatic pistol, wherein the improvement comprises:

a decocking lever operatively affixed to a frame, said decocking lever capable of articulating between a first position to a second position, wherein at said second position said lever is unable to move forward when a hammer is in an uncocked or in a half cock position and moves forward when the hammer is in a fully cocked position;

an eccentric linkage connection formed at a lower end of said decocking lever;

a linkage capable of being articulatably urged between a forward and rearward direction upon movement of the decocking lever;

a pivot lever urged by a forward articulation of said linkage, said pivot lever comprising:

a first pivot lever nub located at a bottom of the pivot lever and operatively interactive to activate a sear; and a second pivot lever nub located at a top of the pivot lever and operatively provides an interference or stop to a hammer;

wherein when the bottom of the pivot lever is urged rearward, the second pivot lever nub moves forward and the first pivot lever nub moves rearward.

10. In the semiautomatic pistol of claim 9, wherein said decocking lever is adapted and configured for a right-handed user such that a user's right thumb is used to articulate the decocking lever.

11. In the semiautomatic pistol of claim 10, further adapted such as to be retrofit into an existing semiautomatic pistol.

* * * * *